US011679471B2

(12) United States Patent
Giese

(10) Patent No.: US 11,679,471 B2
(45) Date of Patent: Jun. 20, 2023

(54) METHOD FOR OPERATING A GRINDING DEVICE

(71) Applicant: Karl Heesemann Maschinenfabrik GmbH & Co. KG, Bad Oeynhausen (DE)

(72) Inventor: Christoph Giese, Herford (DE)

(73) Assignee: Karl Heesemann Maschinenfabrik GmbH & Co. KG, Bad Oeynhausen (DE)

( * ) Notice: Subject to any disclaimer, the term of this patent is extended or adjusted under 35 U.S.C. 154(b) by 1014 days.

(21) Appl. No.: 16/293,871

(22) Filed: Mar. 6, 2019

(65) Prior Publication Data

US 2019/0275636 A1 Sep. 12, 2019

(30) Foreign Application Priority Data

Mar. 6, 2018 (DE) ..... 10 2018 105 133.6

(51) Int. Cl.

| | |
|---|---|
| ***B24B 49/03*** | (2006.01) |
| ***B24B 49/12*** | (2006.01) |
| ***B24B 21/00*** | (2006.01) |
| ***B24B 49/04*** | (2006.01) |
| ***B24B 21/12*** | (2006.01) |
| ***B24B 49/18*** | (2006.01) |

(52) U.S. Cl.

CPC ..... *B24B 49/03* (2013.01); *B24B 21/008* (2013.01); *B24B 21/12* (2013.01); *B24B 49/04* (2013.01); *B24B 49/12* (2013.01); *B24B 49/183* (2013.01)

(58) Field of Classification Search

CPC ..... B24B 49/03; B24B 49/02; B24B 49/045; B24B 49/05; B24B 49/06; B24B 21/008; B24B 21/12; B24B 21/00; B24B 21/18; B24B 21/04; B24B 21/06; B24B 49/04; B24B 49/12; B24B 49/183; B24B 27/0069; B24B 27/0076; B24B 29/005

USPC ..... 451/5, 6, 8–11, 21, 296, 300

See application file for complete search history.

(56) References Cited

U.S. PATENT DOCUMENTS

| | | | | |
|---|---|---|---|---|
| 2002/0186370 | A1 | 12/2002 | Roesner et al. | |
| 2006/0178087 | A1* | 8/2006 | Wuensch | B23Q 11/0046 451/8 |
| 2008/0227367 | A1* | 9/2008 | Birang | G01B 11/06 451/6 |
| 2009/0153859 | A1* | 6/2009 | Kimba | B24B 37/013 356/369 |

(Continued)

FOREIGN PATENT DOCUMENTS

| | | | |
|---|---|---|---|
| CN | 105848826 | A | 8/2016 |
| DE | 10 2007 012 780 | A1 | 9/2007 |

(Continued)

*Primary Examiner* — Joel D Crandall
*Assistant Examiner* — Michael A Gump
(74) *Attorney, Agent, or Firm* — WC&F IP

(57) ABSTRACT

A grinding device is operated by grinding of a surface of the workpiece with at least one grinding medium while recording actual data of the surface after grinding with at least one data collection device. Actual data recorded during grinding is then compared with target data stored in an electronic memory in an electronic data processing device. Based on the comparison, adjustments are made to at least one grinding parameter if a deviation of the actual data from the target data exceeds a predetermined limit.

10 Claims, 1 Drawing Sheet

(56) References Cited

U.S. PATENT DOCUMENTS

| | | | | |
|---|---|---|---|---|
| 2010/0035518 | A1* | 2/2010 | Chang | B24B 37/042 451/6 |
| 2011/0223833 | A1 | 9/2011 | Rauscher et al. | |
| 2016/0059375 | A1* | 3/2016 | Ito | B24B 49/12 382/141 |
| 2020/0122290 | A1* | 4/2020 | Bettermann | B24B 53/007 |

FOREIGN PATENT DOCUMENTS

| | | | | |
|---|---|---|---|---|
| DE | 10 2008 027 050 | A1 | 12/2009 | |
| DE | 10 2009 039 093 | A1 | 3/2011 | |
| DE | 10 2010 011 470 | A1 | 9/2011 | |
| DE | 10 2016 116 622 | A1 | 3/2018 | |
| EP | 0 302 565 | A2 | 2/1989 | |
| WO | 2009/023979 | A1 | 2/2009 | |
| WO | 2015/097146 | A2 | 7/2015 | |
| WO | WO-2015097146 | A2 * | 7/2015 | B24B 49/12 |

* cited by examiner

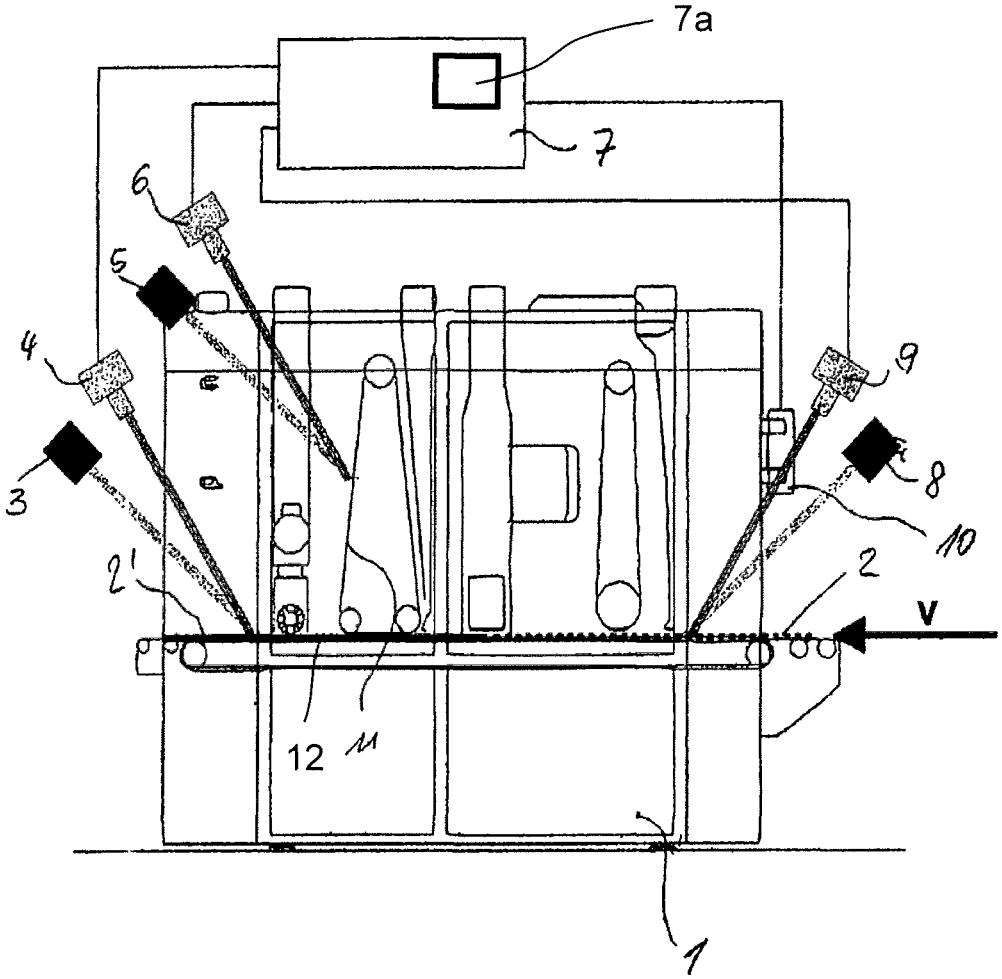
7a
7
6
5
4
3
9
8
10
2'
2
V
12
11
1

METHOD FOR OPERATING A GRINDING DEVICE

FIELD OF THE INVENTION

The invention relates to a method for operating a grinding device and a corresponding grinding device.

BACKGROUND

This type grinding device has been known within the scope of the prior art for many years. They comprise at least one grinding medium, which may be for example a disc brush, a grinding belt or another grinding medium. They are used for grinding, deburring, polishing or treating in another manner surfaces of different workpieces made of different materials. Whereas the aim for many years was to treat the surface of the workpiece that is to be ground in such a way that no grinding pattern was visible, these grinding patterns are increasingly perceived as a decorative element and intentionally created. Nevertheless, there are still some applications for which a grinding pattern should be avoided, if possible.

The object that is to be ground does not always have an even surface which runs parallel to the plane of the grinding medium. The object that is to be ground often features a structured surface with ridges and/or recesses. In order to accommodate this surface structure and produce the desired grinding result, the prior art makes a range of suggestions. For instance, with belt grinding machines that have a circulating grinding belt, an angle between the direction of circulation of the grinding belt and the conveying direction, along which the workpiece is guided through the device, can be adjusted. The pressure with which the grinding belt or a disc brush are pressed onto the surface that is to be ground can also be adjusted. To this end, it is common to use grinding bars which feature several pressure shoes arranged next to one another, wherein said pressure shoes can be driven independently from one another.

The disadvantage is that the respective settings for the workpiece that is to be ground must be adjusted individually. Once the settings have been adjusted, the grinding machine is generally only used to grind workpieces which all feature the same surface structure, meaning that inconvenient adjustments of the various grinding parameters are made as seldom as possible, preferably not at all.

SUMMARY

The invention thus aims to suggest a method for operating a grinding machine and a corresponding grinding machine with which the best possible grinding results can be achieved, preferably as independently as possible from the structure and nature of the surface to be ground.

The invention solves the task by way of a method for operating a grinding device featuring the steps:

a. grinding of a surface of the workpiece with at least one grinding medium,
b. recording of actual data of the surface after grinding by means of at least one data collection device,
c. comparison of the actual data with target data stored in an electronic memory in an electronic data processing device, and
d. adjustment of at least one grinding parameter if a deviation of the actual data from the target data exceeds a predetermined limit.

A method according to the invention enables the monitoring of the grinding result. It is hereby possible to quickly recognize deviations from the desired grinding result in a timely manner and to adjust at least one, or potentially several, grinding parameters of the grinding machine in order to come as close as possible to the target result. This preferably happens completely automatically, without a human having to check or adjust the settings. Using the recorded actual data and the detected deviation from the stored target data, the electronic data processing device is preferably able to identify a countermeasure that can be used to achieve the target data or to at least come within the tolerance range of the target data such that the deviation of the actual data from the target data with the subsequent workpieces to be ground is smaller than the predetermined limit.

The at least one grinding parameter is preferably

- a speed of the grinding medium, preferably a rotation speed of the grinding medium,
- a feed speed of a transport device which transports the workpiece through the grinding device,
- a grinding pressure and/or a dispersion of the grinding pressure of the grinding medium on the workpiece,
- an entry point at which the workpiece comes into contact with the grinding medium,
- the type of grinding medium,
- the connection and/or switching on of grinding units and/or
- the grinding direction of the grinding medium.

The electronic data processing device is configured to adjust at least one, if applicable several or even all of the named grinding parameters. This enables a change in the speed of the grinding medium and/or the feed speed of a transport device. In this manner, a relative speed of the grinding medium to the workpiece is changed, said workpiece being transported through the grinding device. A change in the speed of the grinding medium may also occur, for example, on a grinding belt if an angle between the direction of movement of the grinding belt and the feed speed is altered. This also results in a variation in the relative speed of the grinding belt to the workpiece that is to be ground. If, upon the interpretation of the deviation between the actual data and the target data, it is established that, for instance, the grinding medium is no longer grinding in a uniform manner, but is rather more worn at some points than others for example, the entry point at which the workpiece is introduced into the grinding machine can be altered. This has an influence on which parts of the grinding medium come into contact with the workpiece.

Alternatively or additionally, an additional grinding unit may be connected or a grinding unit that is already in use may be switched on to achieve the desired grinding result.

The electronic data collection device preferably has at least one optical system that comprises at least one camera and preferably at least one light source. The optical system is configured to collect data on at least one part of the surface, preferably the entire surface. This collection and especially the subsequent processing preferably occurs in real-time in order to enable as rapid a reaction as possible to deviations that are greater than the predetermined limit.

The camera is preferably a digital camera which functions in visible light. A camera which operates in the ultra-violet or infrared range may also be used. If the grinding of the workpiece should result, for instance, in the removal of the workpiece coating by way of a substance that is only visible in the infrared range, for example, this can only be checked by using an optical sensor, i.e. a camera, which is able to recognize and process radiation in the infrared range. A light source that is suitable for the camera is preferably used to ensure as efficient an illumination as possible of the surface to be captured by way of the radiation required for the camera.

To this end, the surface is preferably irradiated with electromagnetic radiation from a beam direction when the data collection device captures the surface data, wherein the beam direction is preferably not perpendicular to the surface and/or perpendicular to a feed direction of the transport device. This enables an oblique illumination of the surface up to the grazing incidence of the electromagnetic radiation, which allows irregularities in particular to be easily recognized as they cast a noticeable shadow of the electromagnetic radiation. This is especially advantageous if as smooth a surface as possible is to be produced, which features no or few three-dimensional structures. However, the method can of course be used for other surfaces.

The actual data is preferably used to extract an actual grinding pattern, which is compared to a target grinding pattern.

In a preferred variation of the method, the workpiece is preferably exposed to at least one grinding medium following the adjustment of at least one grinding parameter. This additional grinding medium may be part of the same grinding device or part of a further grinding device. It is used to adjust the grinding device, from which the actual data derives, to the target result.

During the grinding of a workpiece, the actual data is collected by a data collection device. If a comparison with the target data indicates that the deviation is greater than the predetermined limit, the quality of the ground surface clearly does not bear the desired properties or satisfy the desired tolerances. The workpiece is thus generally to be deemed waste and removed from the production cycle. However, if the deviation is due, for instance, to the removal of too little material from the workpiece surface, this can be corrected by exposing the workpiece to a further grinding medium. This particularly beneficial variation of the method therefore allows for a reduction in waste, such that the method is more productive—and thus more cost-effective—overall.

The actual data, which is collected at different points in time, is preferably used to identify a change in the grinding result, on the basis of which a condition of the at least one grinding medium is determined. To this end, the method for operating the grinding device is preferably executed several times in a row. In this case, actual data of several workpieces to be ground is preferably collected after grinding. This allows a chronological development of the grinding result to be identified, which is particularly—but not exclusively—advantageous and simple if the workpieces to be ground are designed to be identical or at least very similar. A change in the grinding result with otherwise preferably unchanged grinding parameters can be used to determine the condition of the grinding medium.

This is preferably used to determine an exchange time at which the at least one grinding medium is changed. For instance, if it is proven that a part of the grinding medium has already been worn by frequent use and the desired grinding result cannot be achieved with this part of the grinding medium, a grinding parameter can first of all be adjusted. This may be the entry point at which the workpiece comes into contact with the grinding medium and/or a pressure with which the grinding medium is pressed onto the workpiece.

However, if it is clear that a change in this grinding parameter is no longer sufficient for achieving the desired grinding result, such that the deviation between the actual data and the target data is smaller than the predetermined limit, the grinding medium must be changed. This can be recognized in advance by the electronic data processing device, such that the exchange time can be determined in advance.

An optical and/or acoustic signal is preferably emitted when the exchange time is reached. This can communicate, for example, to an operator of the grinding device that the grinding medium must be exchanged. In a preferred variation, the grinding medium that is to be exchanged, with the corresponding grinding unit, is switched off at this point and removed from the grinding cycle. It is especially preferable if this grinding unit that has been exchanged and switched off is replaced by an identical or similar grinding unit, such that other workpieces can be processed, even during the exchange of the grinding medium of the grinding unit that has been removed from the grinding cycle.

The invention also solves the problem by means of a grinding device with at least one grinding medium, at least one data collection device and at least one electronic data processing device, which is configured to conduct a method in the manner described.

This preferably comprises the recording of actual data of the at least one grinding medium by means of at least one data collection device. This actual data is preferably compared with target data stored in an electronic memory in an electronic data processing device. This is used to determine an exchange time at which the at least one grinding medium is changed.

The actual data that is recorded is to be selected such that it permits an assertion to be made on the condition of the grinding medium. To this end, the actual data is preferably recorded directly at the grinding medium. Alternatively or additionally, it is also possible to indirectly draw a conclusion about the condition of the grinding medium, for instance if the actual data relates to the grinding quality and thus the grinding result. This renders it possible, for example, to record the surface of the ground workpiece after grinding and to thereby draw a conclusion about the condition of the grinding medium, amongst other factors.

The actual data is preferably recorded at different times, such that a chronological sequence emerges. This can be used to detect the exchange time by, for instance, extrapolating the data to determine when the grinding medium is no longer of the quality required for the desired grinding result.

The at least one grinding medium is preferably changed when it reaches the exchange time.

In a preferred configuration, the electronic data collection device has an optical system that comprises at least one camera and/or preferably a light source. The light source is preferably used to illuminate at least the points of the grinding medium that are captured by the camera. A camera should be understood here to mean any optical sensor which is able to detect electromagnetic radiation. This may lie within the visible light spectrum, in the UV range and/or in the infrared range.

It is especially preferable if the recorded actual values relate to the length and/or the color of the grinding medium. Alternatively or additionally, the actual values relate to another parameter of the grinding belt which changes with the increasing wear of the grinding belt. For instance, if the grinding medium is a brush head with grinding elements that protrude from a carrier, the length of these grinding elements changes with the wear of the grinding medium. This length can then be identified. As soon as the length drops below a predetermined limit, the grinding medium is deemed to no longer be of sufficient quality to achieve the desired grinding result and must thus be exchanged. If, for example, the grinding medium is a grinding belt, this grinding belt features a base body which is coated with the actual grinding medium, such as sand or granulate. As wear increases, the actual grinding elements are removed from the carrier so the color of the carrier becomes clear. This color can be detected. As soon as the color, which in this case represents the actual value, reaches a particular color, the grinding belt must be exchanged.

Alternatively or additionally, it is possible to measure how much residue of the workpiece surface that is to be ground is present on the grinding belt. The fresher and newer the grinding belt, the deeper the recesses between the individual sand or granulate elements which form the actual grinding element. The deeper these spaces, the more residue is found between them. In particular, if the residue is of a considerably different color to the actual grinding belt, this color can also be detected. As soon as the color of the residue in the captured image diminishes, an assertion can be made on the decreasing depth of the individual recesses between the sand or granulate elements. This provides information on the condition of the grinding medium.

In a preferred configuration, the length of the grinding medium is determined by a distance of the grinding medium carrier, to which the at least one grinding medium is arranged, from the surface of the workpiece and/or from a transport device which transports the workpiece through the grinding device. This is especially advantageous if it concerns a grinding brush which has several individual grinding elements that protrude from a grinding medium carrier. In this case, the length of the grinding element is the criteria on which the assertion on the condition of the grinding medium is based.

The grinding device preferably comprises several grinding media, at least two of which are designed to be different from one another. These may be brush sanding elements, grinding belts or other grinding facilities.

The data collection device preferably comprises an optical system with at least one camera and/or at least one optical sensor, wherein the optical system preferably comprises at least one light source.

In a preferred configuration, the light source of the grinding device is preferably a lighting device for illuminating the workpiece surface during collection of the actual data.

DESCRIPTION OF THE DRAWINGS

In the following, an example of an embodiment of the present invention will be explained in more detail by way of the attached drawing which shows:

FIG. 1—a schematic sectional view through a grinding device.

DETAILED DESCRIPTION

FIG. 1 shows a grinding device 1 with a transport device, by means of which a workpiece 12 can be transported through the grinding device 1. During this process, the workpiece 12 moves from an inlet 2 of the grinding device to an outlet 2' of the grinding device 1. It is moved along the arrow shown in FIG. 1 at a transport speed v.

A data collection device 4 is located within the vicinity of the outlet 2', this device being configured to collect actual data of the workpiece surface after grinding. The grinding device 1 also has a lighting device 3, which is configured to illuminate the area of the workpiece surface captured by the data collection device 4 with electromagnetic rays. The actual data collected by the data collection device 4 is fed into an electronic data processing device 7 where it is processed and especially compared with target data stored in an electronic memory 7*a* which may form part of the electronic data processing device 7.

The grinding device 1 also features another data collection device 9, to which a lighting device 8 is also allocated. The lighting device 8 illuminates a part of the workpiece surface in the vicinity of the inlet 2 of the grinding device 1. The illuminated area is captured by the data collection device and the actual data is collected prior to grinding. In the example of an embodiment shown, this is also fed into the electronic data processing device. A third data collection device 6 is provided to capture actual data of at least one part of a grinding medium 11, preferably the entire grinding medium 11. A corresponding lighting device 5 is also allocated to this data collection device 6, said lighting device being used to illuminate at least one part of the grinding medium 11 with an electromagnetic ray. The actual data of this data collection device 6 is also fed into the electronic data processing device.

The electronic data processing device 7 generates control signals that are fed into a control unit 10, which is configured to regulate at least one operating parameter of the grinding device and to adjust it on the basis of the control signals.

REFERENCE LIST

1 Grinding device
2 Inlet
2' Outlet
3 Lighting device
4 Data collection device
5 Lighting device
6 Data collection device
7 Electronic data processing device
8 Lighting device
9 Data collection device
10 Control unit
11 Grinding medium
12 workpiece

The invention claimed is:

1. A method for operating a grinding device, comprising:

grinding of a surface of a workpiece with at least one grinding medium, recording actual data of the surface of the workpiece after grinding with at least one data collection device, comparing the actual data with target data stored in an electronic memory in an electronic data processing device, adjusting at least one grinding parameter if a deviation of the actual data from the target data exceeds a predetermined limit, collecting the actual data at different points in time, using the actual data collected at the different points in time to identify a change in a grinding result, determining a condition of the at least one grinding medium based on the actual data collected at the different points in time, determining an exchange time at which the at least one grinding medium is changed, and emitting one or more of an optical signal and an acoustic signal when the exchange time is reached, wherein the at least one data collection device has at least one optical system that comprises one or more of at least one camera, and at least one light source, wherein the optical system is configured to collect the actual data on at least one part of the surface of the workpiece, and wherein the optical system collects the actual data on an entirety of the surface of the workpiece.

2. The method according to claim 1, wherein the at least one grinding parameter is a speed of the at least one grinding medium, a feed speed of a transport device which transports the workpiece through the grinding device, a grinding pressure and/or a dispersion of the grinding pressure of the at least one grinding medium on the workpiece, an entry point at which the workpiece comes into contact with the at least one grinding medium, a type of grinding medium, a connection and/or switching on of grinding units, and/or a grinding direction of the at least one grinding medium.

3. The method according to claim 1, wherein the optical system collects the actual data in real-time.

4. The method according to claim 1, further comprising the steps of extracting an actual grinding pattern from the actual data, and comparing said actual grinding pattern with a target grinding pattern.

5. The method according to claim 1, further comprising exposing the workpiece to at least one grinding medium following adjustment of the at least one grinding parameter.

6. A method for operating a grinding device, comprising:

grinding of a surface of a workpiece with at least one grinding medium, recording actual data of the surface of the workpiece after grinding with at least one data collection device, comparing the actual data with target data stored in an electronic memory in an electronic data processing device, adjusting at least one grinding parameter if a deviation of the actual data from the target data exceeds a predetermined limit, collecting the actual data at different points in time, irradiating the surface of the workpiece with electromagnetic radiation from a beam direction when the at least one data collection device collects the actual data of the surface of the workpiece, wherein the beam direction is not perpendicular to a feed direction of a transport device which transports the workpiece through the grinding device, using the actual data collected at the different points in time to identify a change in a grinding result, determining a condition of the at least one grinding medium based on the actual data collected at the different points in time, determining an exchange time at which the at least one grinding medium is changed, and emitting one or more of an optical signal and an acoustic signal when the exchange time is reached, wherein the at least one data collection device has at least one optical system that comprises one or more of at least one camera, and at least one light source, wherein the optical system is configured to collect the actual data on at least one part of the surface of the workpiece.

7. The method of claim 6, wherein the beam direction is not perpendicular to the surface of the work piece.

8. A grinding device, comprising:

at least one grinding medium, at least one data collection device, and at least one electronic data processing device, which are configured to grind a surface of a workpiece with the at least one grinding medium, record actual data of the surface of the workpiece after grinding with the at least one data collection device, compare the actual data with target data stored in an electronic memory in the at least one electronic data processing device, adjust at least one grinding parameter if a deviation of the actual data from the target data exceeds a predetermined limit, collect the actual data at different points in time with the at least one data collection device, use the actual data collected at the different points in time to identify a change in a grinding result, determine a condition of the at least one grinding medium based on the actual data collected at the different points in time, determine an exchange time at which the at least one grinding medium is to be changed, and emit one or more of an optical signal and an acoustic signal when the exchange time is reached, wherein the at least one grinding medium includes at least a plurality of grinding media at least two of which are different from each other.

9. The grinding device according to claim 8, wherein the at least one data collection device comprises a camera and/or at least one sensor.

10. The grinding device according to claim 8, further comprising a lighting device for illuminating the surface of the workpiece while the actual data is being captured.

* * * * *